United States Patent [19]

van Mullekom

[11] Patent Number: 4,784,188

[45] Date of Patent: Nov. 15, 1988

[54] AIR JET WEAVING MACHINE

[75] Inventor: Hubert P. van Mullekom, Deurne, Netherlands

[73] Assignee: Sulzer Brothers Ltd., Winterthur, Switzerland

[21] Appl. No.: 939,134

[22] Filed: Dec. 8, 1986

[30] Foreign Application Priority Data

Dec. 20, 1985 [CH] Switzerland ..... 05455/85

[51] Int. Cl.[4] ..... D03D 49/50

[52] U.S. Cl. ..... 139/116; 139/429; 139/302

[58] Field of Search ..... 139/1 R, 116, 429, 435, 139/302, 194

[56] References Cited

U.S. PATENT DOCUMENTS 4,503,891 3/1985 Novak et al. ..... 139/116
4,531,555 7/1985 Tatematsu et al. ..... 139/302
4,711,275 12/1987 Kato et al. ..... 139/435

FOREIGN PATENT DOCUMENTS 0094089 11/1983 European Pat. Off. .
0100939 2/1984 European Pat. Off. .
0161376 11/1985 European Pat. Off. .
2090294 7/1982 United Kingdom .

*Primary Examiner*—Henry S. Jaudon
*Attorney, Agent, or Firm*—Burns, Doane, Swecker & Mathis

[57] ABSTRACT

An air jet weaving machine has a weft deflector (7, 90, 23, 22) to keep the weft yarn away from the shed after the occurrence of a disturbance. The deflector is disposed between the picking nozzle (61) and the weft yarn entry into the weft duct (12). Before the discharge orifice of the picking nozzle (61) in the rear position of the sley (10) a rod-like yarn guide (90) extends as far as the shears (8), deflects the yarn into the funnel (23) and introduces the yarn into the shears (8). Thanks to the provision of the yarn guide (90), the weft yarn can be parted off by a single pair of shears (8) both after a normal pick and after a deflection. The weft yarn (5) is deflected by a blowing nozzle (7) transversely to the picking nozzle (61) by way of the yarn guide (90) and is removed by way of a funnel (23).

7 Claims, 2 Drawing Sheets

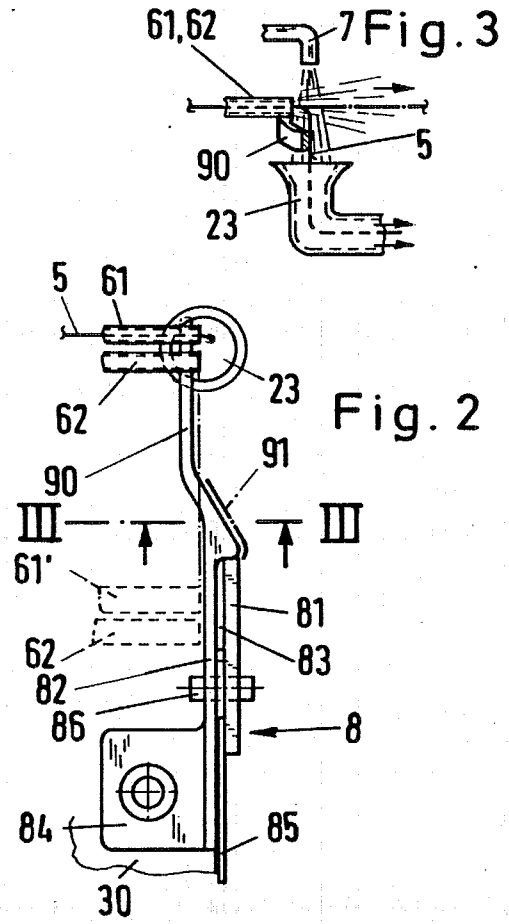
Fig. 3
7
5
61,62
90
23
Fig. 2
23
91
III
81
83
8
85
61
5
62
90
III
61'
62
82
86
84
30
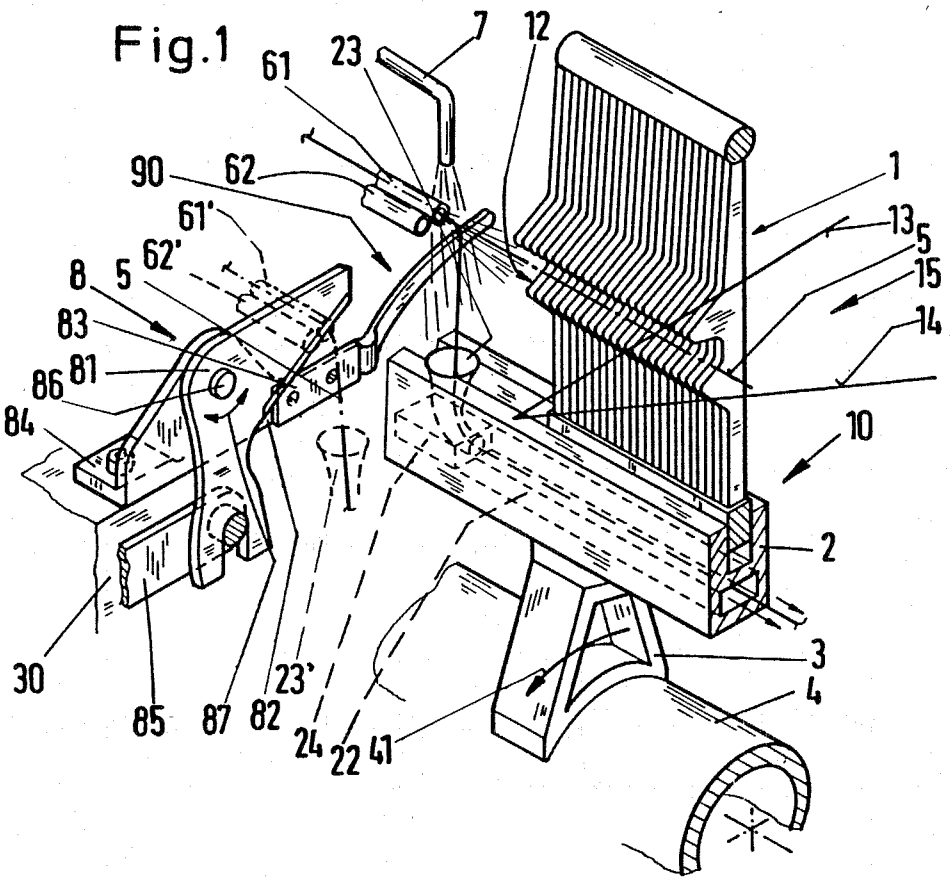
Fig. 1
1
13
5
15
14
10
2
3
4
12
7
23
61
62
90
61'
62'
5
8
83
81
86
84
85
30
87
82
23'
24
22
41

AIR JET WEAVING MACHINE

The invention relates to an air jet weaving machine having a picking nozzle outside the shed; a weft yarn deflector disposed between such nozzle and the shed and operative to keep the weft yarn away from the shed in response to a machine stop signal; and a yarn guide.

In the system disclosed by UK Patent Application GB No. 2 090 294, in order to deflect the weft yarn from the normal picking direction, the picking nozzle pivots from its normal position into an upwardly inclined position in front of the entry orifice of a suction extractor, so that the weft yarn is guided away from the weft duct into the extractor. GB No. 2 090 294 discloses a yarn guide which is secured to the shears for severing the weft yarn and which is operative to deflect the yarn into the zone between the blades of the shears when the weft yarn is deflected by the extractor disposed above the weft duct. The disadvantage of this kind of weft yarn deflector is that the picking nozzle has to have a drive mechanism and must also be mounted pivotally.

It is an object of this invention to provide an air jet weaving machine having a weft yarn deflector which is improved in this respect, no additional movement of the operative elements being necessary to initiate deflection.

It will be convenient to describe the invention with reference to a loom oriented so that a main air jet from a main picking nozzle inserts the weft in a horizontal direction in front of a vertically extending reed which itself moves generally horizontally to and fro in a direction generally at right angles to the direction of weft insertion. The main air nozzle moves bodily to and from with the reed during the course of the weaving operations. Shears are carried by the loom at the same side of the loom as the main nozzle, but they do not move to and fro with the reed. These shears are located forwardly of the zone where the reed is disposed during a weft insertion event (a "pick"), the arrangement being such that, when the reed beats up an inserted weft length against the fell of the cloth being woven, the portion of that weft extending laterally from the edge of the warp sheet to the main nozzle will move into the zone of action of the shears and be severed thereby.

In accordance with an embodiment of the invention, the occurrence of a machine stop signal serves to initiate discharge of a yarn deflecting jet from a downwardly directed nozzle located above the level of normal weft insertion and laterally between the discharge end of the main weft insertion nozzle and the adjacent edge of the warp shed. The arrangement is such that the downwardly moving jet intersects the horizontal main jet to blow any weft increment located there in a downward direction. A funnel or other receiver element is also movable to and fro with the reed and is located in line with the yarn deflecting jet at a location below the level of weft insertion to receive the deflected weft, and suction means connected to the funnel carries the received weft length away.

Located at a level between the horizontal axis of the main weft inserting nozzle and the funnel, there is an elongated yarn guide arm that is so mounted that it does not move with the reed. The forward end portion of this yarn guide arm is located adjacent the shears and the rear end portion is located beneath the discharge end of the main nozzle.

When the weft deflection nozzle is activated to blow a weft length down into the funnel, the portion of the weft yarn between the main nozzle and the funnel will be located on the side of the yarn guide arm facing the shed. Then, as the reed and the main nozzle and the funnel all move forwardly toward the fell of the cloth, this portion of the weft thread will be guided along the length of the yarn guide arm. The shape of the yarn guide arm is such that the weft will be guided a short distance toward the edge of the cloth being woven as it is moved forwardly along the yarn guide arm, so that the shears may act effectively to sever the yarn between the main nozzle and the funnel.

Hence, it will be seen that, in accordance with the invention, the weft yarn deflector comprises: a blowing nozzle disposed transversely to the free jet from the picking nozzle; and a funnel which extends in the same direction, the jet from the blowing nozzle crossing the free jet from the picking nozzle. The blowing nozzle of the weft yarn deflector is so disposed above the picking nozzle after the discharge orifice thereof as considered in the picking direction as to be operative vertically downwards, and the funnel for intercepting the weft yarn is disposed beneath in the sley of the machine. To deflect the yarn from the picking nozzle into the deflector, the yarn guide is disposed before, as seen from the picking nozzle, the intersection between the free jet from the picking nozzle and the jet from the blowing nozzle and transversely to and adjacent the free jet, and the yarn guide is disposed, as seen from the blowing nozzle, after such intersection and also transversely to the jet from the blowing nozzle. The yarn guide must extend at least over a length corresponding to the range of movement of the picking nozzle transversely to the picking direction, the yarn guide extending in the direction of movement of the picking nozzle. That end of the yarn guide which is near the reed is disposed, as considered in the picking direction, before the plane in which the discharge orifice of the picking nozzle moves. Its other end is disposed behind the plane in which the shears move during severance, to ensure that weft yarn is introduced reliably and securely into the shears.

The yarn carrier or guide can be an extension of one of the shears blades. For example, the bottom blade of the shears can be releasably secured to the yarn guide.

The device described is compact and of simple construction.

The invention will be described in detail hereinafter with reference to the drawings wherein:

FIG. 1 is an overall perspective view of an arrangement with which the invention is concerned;

FIG. 2 is a view of the arrangement transversely to the picking direction and to the yarn guide;

FIG. 3 is a section on the line III—III of FIG. 2, and

Figure 4:
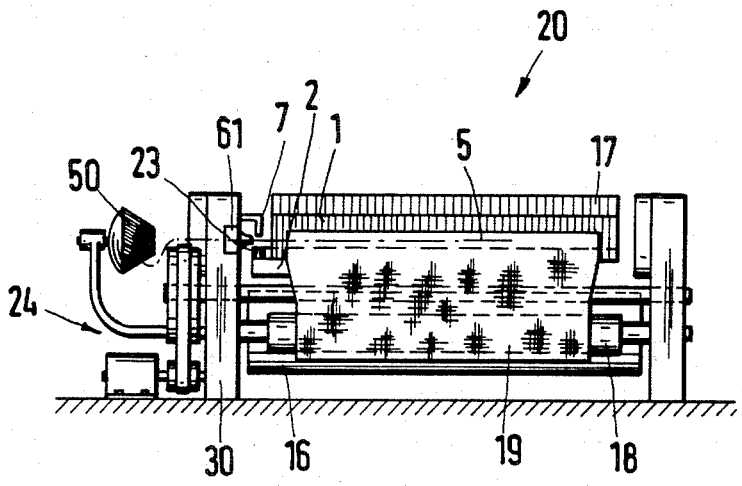
FIG. 4 is a diagrammatic view of an air jet weaving machine having the weft yarn deflector.

A weaving machine 20 shown in FIG. 4 has means for driving inter alia a reed 1 and reed holder 2. Weft yarn 5 is drawn off a bobbin 50 and blown along the reed 1 by a picking nozzle 61. Warp yarns extend from a warp beam 16 by way of shafts 17 through the reed 1 and, after the weft yarn 5 has been picked and beaten up, wound as cloth 19 on a cloth beam 18. A picking nozzle 61 and a blowing nozzle 7 are secured to the casing 30 and an extraction funnel is disposed on the reed holder 2 below the blowing nozzle 7.

When the machine operates normally, the weft yarn is injected by the picking nozzle 61 or 62 into a weft duct 12, as shown in FIG. 2, within shed 15. The reed 1 forms the weft duct 12 in the manner shown in FIG. 1 During picking the duct 12 is disposed in the shed 15 formed by the warp yarns 13, 14 which are stretched over the weaving width. The reed 1 is secured in the reed holder 2, the same being connected by way of a number of levers 3 to shaft 4. The complete arrangement between the reed 1 and the shaft 4 is called the sley 10.

During picking the sley 10 moves together with the picking nozzles 61, 62 forwardly in the direction of the arrow 41 as the shaft 4 rotates. At the end of this movement the picking nozzles 61, 62 are in the respective position 61', 62' behind the shears 8 in FIG. 1 where the weft yarn is severed. The sley then pivots back in the direction opposite to that indicated by the arrow 41.

In the event of the machine stopping automatically because of a disturbance, the requirement is that a weft yarn prepared for picking should not be able to enter the shed 15. Instead, the blowing nozzle 7 blows the weft yarn past the yarn guide 90 into the funnel 23 and into a conveying duct or line 22 inside the reed holder 2. Consequently, the weft yarn deflector comprises: a blowing nozzle 7 above the exit orifice of the picking nozzle 61, 62; the yarn guide 90; and the funnel 23 which is engaged in the reed holder 2 by way of an end member 24. A negative pressure is operative in the funnel 23 and duct 22 to extract the weft yarn 5 by suction. Suitable means for creating the negative pressure in duct 22 and for removing the weft yarn length from the system are disclosed in U.S. Pat. No. 4,729,411 of Kurt Ellenberger and Georg Senn filed concurrently herewith, and the entire disclosure of such application is incorporated herein by reference.

In the deflecting operation at the start of picking, the air stream or jet from the nozzle 7 deflects the weft yarn 5 downwardly so that the same dips directly into the funnel 23. The end of the yarn guide 90 is below the picking nozzles 61, 62 to the left of the exit orifices thereof, as shown in FIG. 2. During deflection the main nozzles move towards the respective positions 61', 62' near the shears 8. The weft yarn slides over the edge, the direction of which has swung slightly to the right and downwardly in FIG. 2, along a chain-dotted line 91 between shears blades 81 and 82. A cutting edge 83 is releasably secured to the blade 82. The funnel 23 at the start of the line 22 is therefore positioned as in FIG. 1 below the shears 8 in position 23'. Deflection ends with the severance of the weft yarn by the descent of the top shears blade 81, the same being mounted for rotation in the spindle 86 and being moved by a drive lever 85.

FIG. 3 is a view to a smaller scale than in FIG. 2 and in section on the line III—III thereof of an intermediate position during deflection, in which position the weft yarn is positioned just above the section plane III13 III of FIG. 2.

As can be gathered from FIGS. 1 and 2, the yarn guide 90, bottom shears blade 82 and a securing flange 84 form a unitary assembly which also carries the top shears blade 81 by means of a spindle 86. Flange 84 is screwed to a casing 30. During severance the top blade moves around the pivot 86, as indicated by an arrow 87, sliding above the cutting edge 83 of the bottom blade 81.

The yarn guide 90 can be secured to the machine frame or casing 30 without being directly connected to the bottom blade 82 if so devised that at the end of deflection the picking nozzle 61 or 62 tensions the weft yarn in the gap between the blades 81 and 82.

The yarn guide 90 is also of use in air jet weaving machines having only one nozzle 61 or more than two nozzles 61, 62.

While the invention has been described with particular reference to an embodiment illustrated in the drawings, it will be evident that variations and modifications are possible. It is intended therefore that the scope of the invention be ascertained from the following claims.

What is claimed is:

1. An air jet loom in which a warp shed is formed through which a weft yarn may be inserted, said loom comprising a picking nozzle outside said shed for directing an air jet into the shed so as to introduce the weft yarn into the shed, a downwardly directed diverting nozzle for blowing a downwardly moving jet of air upon the occurrence of a machine stop signal, said diverting nozzle being disposed between said picking jet and the adjacent edge of the shed and directing its jet of air into intersecting relationship to the path of the jet of air from said picking nozzle, a receiver below the level of said picking nozzle in alignment with said diverting nozzle for receiving a weft yarn diverted by the jet from said diverting nozzle, and yarn guide means for assuring passage of said weft yarn to said receiver under the influence of the jet blown from said diverting nozzle, said yarn guide means being disposed in the zone between the discharge end of the picking jet and the adjacent edge of the shed at a location below the axis of the picking nozzle and closer to the discharge end of the picking nozzle than the axis of the diverting nozzle, said yarn guide being independent from the blowing nozzle and the funnel and being stationarily mounted on the machine frame; said picking nozzle and funnel being movable together relative to said stationarily mounted yarn guide.

2. An air jet weaving machine having a reed and a picking nozzle outside a shed both reciprocable with a sley; weft yarn deflector means disposed between such nozzle and the shed and operative to keep the weft yarn away from the shed in response to a machine stop signal, said weft yarn deflector means comprising a blowing nozzle disposed transversely to the axis of the picking nozzle and a funnel which extends in the same direction as the blowing nozzle, the axis of the blowing nozzle crossing the axis of the picking nozzle; and a yarn guide disposed before, as seen from the picking nozzle, the intersection between the axis of the picking nozzle and the axis of the blowing nozzle and transversely to and adjacent the jet from the picking nozzle, said yarn guide also being disposed, as seen from the blowing nozzle, after such intersection and also transversely to the axis of the blowing nozzle, said yarn guide being independent from the blowing nozzle and the funnel and being stationarily mounted on the machine frame; said picking nozzle and funnel being movable together with the sley relative to said stationarily mounted yarn guide.

3. A machine according to claim 2, wherein the yarn guide is independent from the sley and extends at least over a length corresponding to the range of movement of the picking nozzle transversely to the picking direction, the yarn guide being a bar extending in the direction of movement of the picking nozzle.

4. A machine according to claim 3, additionally including shears and wherein the end of the yarn guide which is nearest the reed in its rearmost position is disposed, as considered in the picking direction, before the plane in which the discharge orifice of the picking nozzle moves, and the other end of the yarn guide is disposed rearwardly of the plane in which the shears move during severance.

5. A machine according to claim 2, additionally including shears blades for severing a weft thread length extending from the discharge end of said picking nozzle, and wherein said yarn guide is an extension of one of said shears blades.

6. A machine according to claim 5, characterized in that the shears include a bottom cutting edge releasably attached thereto.

7. A machine according to claim 2, characterized in that the blowing nozzle is so disposed above the picking nozzle as to be operative vertically downward, and the funnel is disposed on the sley of the machine

* * * * *